US007236068B2

(12) United States Patent
Shamsaifar et al.

(10) Patent No.: US 7,236,068 B2
(45) Date of Patent: Jun. 26, 2007

(54) ELECTRONICALLY TUNABLE COMBINE FILTER WITH ASYMMETRIC RESPONSE

(75) Inventors: Khosro Shamsaifar, Ellicott City, MD (US); Henry Eniola, Laurel, MD (US)

(73) Assignee: Paratek Microwave, Inc., Columbia, MD (US)

( * ) Notice: Subject to any disclaimer, the term of this patent is extended or adjusted under 35 U.S.C. 154(b) by 59 days.

(21) Appl. No.: 10/051,144

(22) Filed: Jan. 17, 2002

(65) Prior Publication Data

US 2003/0132820 A1 Jul. 17, 2003

(51) Int. Cl.
*H01P 3/08* (2006.01)

(52) U.S. Cl. ..... 333/205; 333/204; 333/202

(58) Field of Classification Search ..... 333/203, 333/204, 205, 207, 209
See application file for complete search history.

(56) References Cited

U.S. PATENT DOCUMENTS 3,602,848 A * 8/1971 Leonard ..... 333/206
4,418,324 A * 11/1983 Higgins ..... 333/204
4,551,696 A 11/1985 Moutrie et al.
4,963,843 A 10/1990 Peckham
4,992,759 A * 2/1991 Giraudeau et al. ..... 333/204
5,138,288 A 8/1992 Blackburn
5,192,926 A * 3/1993 Sogo et al. ..... 333/205 X
5,227,748 A 7/1993 Sroka
5,373,271 A * 12/1994 Hirai et al. ..... 333/204
5,392,011 A 2/1995 Li
5,416,454 A 5/1995 McVeety
5,427,988 A 6/1995 Sengupta et al.
5,543,764 A * 8/1996 Turunen et al. ..... 333/202
5,635,433 A 6/1997 Sengupta
5,635,434 A 6/1997 Sengupta
5,640,042 A * 6/1997 Koscica et al. ..... 257/595
5,648,747 A 7/1997 Grothe et al.
5,693,429 A 12/1997 Sengupta et al.
5,719,539 A 2/1998 Ishizaki et al.
5,739,735 A 4/1998 Pyykkö et al.
5,766,697 A 6/1998 Sengupta et al.
5,830,591 A 11/1998 Sengupta et al.
5,846,893 A 12/1998 Sengupta et al.
5,896,073 A 4/1999 Miyazaki et al.
6,018,282 A * 1/2000 Tsuda ..... 333/205

(Continued)

OTHER PUBLICATIONS

U.S. Appl. No. 09/419,126, filed Oct. 15, 1999, Sengupta et al.
U.S. Appl. No. 09/457,943, filed Dec. 9, 1999, Sengupta et al.
U.S. Appl. No. 09/594,837, filed Jun. 15, 2000, Chiu.

(Continued)

*Primary Examiner*—Robert Pascal
*Assistant Examiner*—Kimberly E Glenn
(74) *Attorney, Agent, or Firm*—James S. Finn

(57) ABSTRACT

Electronic filters include an input, an output and a plurality of resonators series coupled between the input and the output. Each of the resonators is coupled to a tunable capacitance. In addition, a coupling means is provided between non-adjacent ones of the resonators. The resonators can include microstrip resonators, stripline resonators, resonant cavities, or other types of resonators. The tunable capacitance can be provided by tunable dielectric varactors or microelectromechanical variable capacitors. Another tunable capacitor can be included in the coupling means to provide a tunable notch response.

8 Claims, 5 Drawing Sheets

U.S. PATENT DOCUMENTS

| | | | | |
|---|---|---|---|---|
| 6,074,971 | A | 6/2000 | Chiu et al. | |
| 6,111,482 | A | 8/2000 | Atokawa | |
| 6,300,849 | B1 * | 10/2001 | Takeda | 333/204 X |
| 6,597,265 | B2 * | 7/2003 | Liang et al. | 333/204 |
| 6,686,817 | B2 * | 2/2004 | Zhu et al. | 333/205 |
| 2002/0093400 | A1 * | 7/2002 | Zhu et al. | 333/205 |
| 2002/0149448 | A1 * | 10/2002 | Toncich | 333/205 |

OTHER PUBLICATIONS

U.S. Appl. No. 09/768,690, filed Jan. 24, 2001, Sengupta et al.
U.S. Appl. No. 09/834,327, filed Apr. 13, 2001, Chang et al.
U.S. Appl. No. 09/882,605, filed Jun. 15, 2001, Sengupta.
U.S. Appl. No. 10/013,265, filed Dec. 10, 2001, Shamsaifar et al.
U.S. Appl. No. 60/295,046, filed Jun. 1, 2001, Luna et al.

* cited by examiner

ELECTRONICALLY TUNABLE COMBINE FILTER WITH ASYMMETRIC RESPONSE

FIELD OF INVENTION

The present invention relates generally to electronic filters, and more particularly, to tunable filters that operate at microwave and radio frequency frequencies.

BACKGROUND OF INVENTION

Wireless communications applications have increased to crowd the available spectrum and drive the need for high isolation between adjacent bands. Portability requirements of mobile communications additionally require a reduction in the size of communications equipment. Filters used in communications devices have been required to provide improved performance using smaller sized components. Efforts have been made to develop new types of resonators, new coupling structures, and new configurations to address these requirements.

Electrically tunable microwave filters have many applications in microwave systems. These applications include local multipoint distribution service (LMDS), personal communication systems (PCS), frequency hopping radio, satellite communications, and radar systems. There are three main kinds of microwave tunable filters, including mechanically, magnetically, and electrically tunable filters. Mechanically tunable filters suffer from slow tuning speed and large size. Compared to mechanically and magnetically tunable filters, electrically tunable filters have the important advantages of small size and fast tuning capability over relatively wide frequency bands. Electrically tunable filters include voltage-controlled tunable dielectric capacitor based tunable filters, and semiconductor varactor based tunable filters. Compared to semiconductor varactor based tunable filters, tunable dielectric capacitor based tunable filters have the merits of lower loss, higher power-handling, and higher IP3, especially at higher frequencies (>10 GHz).

Tunable filters offer communications service providers flexibility and scalability never before accessible. A single tunable filter can replace several fixed filters covering adjacent frequencies. This versatility provides transceiver front end RF tunability in real time applications and decreases deployment and maintenance costs through software controls and reduced component count. Also, fixed filters need to be wide band so that their count does not exceed reasonable numbers to cover the desired frequency plan. Tunable filters, however, are typically narrow band, but they can cover a larger frequency band than fixed filters by tuning the filters over a wide range. Additionally, narrowband filters at the front end are appreciated from the systems point of view, because they provide better selectivity and help reduce interference from nearby transmitters.

Commonly owned U.S. patent application Ser. No. 09/419,126, filed Oct. 15, 1999, and titled "Voltage Tunable Varactors And Tunable Devices Including Such Varactors", discloses voltage tunable dielectric varactors that operate at room temperature and various devices that include such varactors, and is hereby incorporated by reference.

Commonly owned U.S. patent application Ser. No. 09/457,943, filed Dec. 9, 1999, and titled "Electronic Tunable Filters With Dielectric Varactors", discloses microstrip filters including voltage tunable dielectric varactors that operate at room temperature, and is hereby incorporated by reference.

Commonly owned U.S. patent application Ser. No. 10/013,265, filed Dec. 10, 2001, and titled "Electrically Tunable Notch Filters" discloses electronically tunable notch filters, and is hereby incorporated by reference.

Combline filters are attractive for use in electronic communications devices. It is well known that combline filters, in general, have a natural transmission zero above its passband. One of the techniques used to reduce the number of resonators is to add cross couplings between non-adjacent resonators to provide transmission zeros. Examples of this approach are shown in U.S. Pat. No. 4,418,324 and 5,543,764.

In some filter applications, a tunable asymmetric response is desirable. There is a need for tunable filters with an asymmetric response.

SUMMARY OF THE INVENTION

The electronic filters of this invention include an input, an output and a plurality of resonators series coupled between the input and the output. Each of the resonators is coupled to a tunable capacitance. In addition, a coupling means is provided between non-adjacent ones of the resonators.

The resonators can include microstrip resonators, stripline resonators, resonant cavities, or other types of resonators. The tunable capacitance can be provided by tunable dielectric varactors or microelectromechanical variable capacitors. Another tunable capacitor can be included in the coupling means to provide a tunable notch response.

The filters of this invention provide an asymmetric response function.

DETAILED DESCRIPTION OF THE INVENTION

Figure 1:
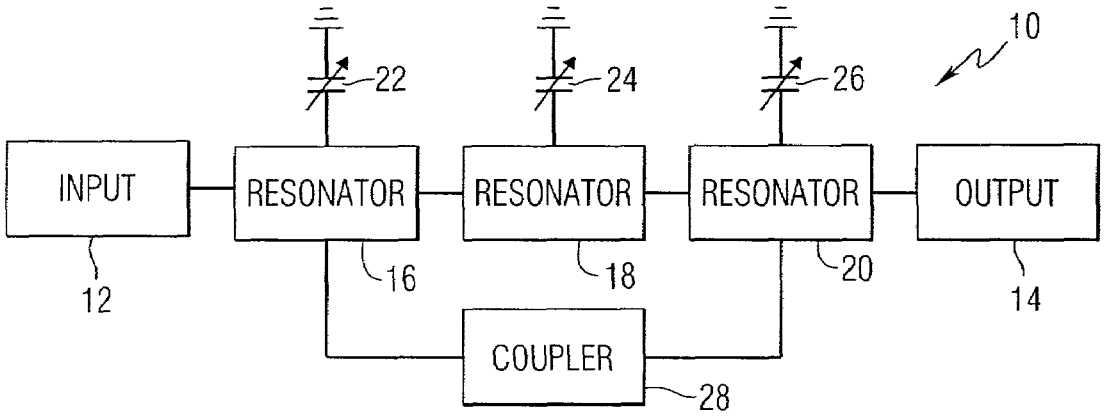
FIG. 1 is a block diagram of a filter constructed in accordance with the invention.

This invention provides tunable filters with an asymmetric frequency response that include cross coupling between two non-adjacent resonators to provide a transmission zero on one side of the passband of the filter. Referring to the drawings, FIG. 1 is a block diagram of a filter 10 constructed in accordance with the invention. The filter 10 includes an input 12 and an output 14. A plurality of resonators 16, 18, and 20 are serially coupled to each other and to the input and output. Tunable capacitors 22, 24 and 26 are coupled to the resonators. A coupling means 28 couples non-adjacent resonators 16 and 20.

Various structures can be used to construct the filter, such as microstrips, striplines, coaxial lines, dielectric resonator, waveguides, etc. While the example filter of FIG. 1 includes three resonators, it should be understood that additional series coupled resonators can be used in the filters of this invention. Additional cross couplings can be provided between any non-adjacent resonators, depending on the desired frequency response requirement. Variations of the capacitance of the tunable capacitors affect the distribution of the electric field in the filter, which in turn varies the resonant frequency.

Figure 2:
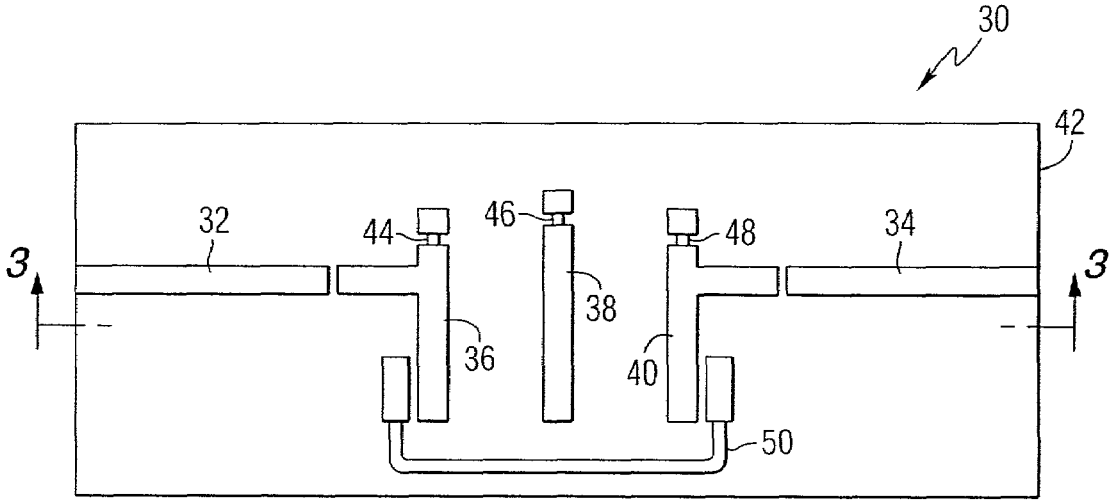
FIG. 2 is a plan view of a combline filter constructed in accordance with the invention.

A combline bandpass filter 30 using microstrip technology is shown in FIG. 2. The filter of FIG. 2 includes an input microstrip line 32, an output microstrip line 34 and a plurality of resonators 36, 38 and 40 which are serially coupled to each other and between the input and output lines. Input line 34 is coupled to resonator 40 through a stub line extending from resonator 36. Output line 32 is coupled to resonator 36 through a stub line extending from resonator 40. The resonators are mounted on a dielectric substrate 42. Tunable capacitors 44, 46 and 48 are each connected between one end of one of the resonators and a ground. A microstrip 50 serves as means for coupling resonators 36 and 40. The microstrip 50 is capacitively coupled to each of the microstrip resonators 36 and 40 at an end opposite to the end that is connected to the variable capacitor. The filter of FIG. 2 is a 3-pole tunable combline filter with coupling between resonators 36 and 40.

Figure 3:
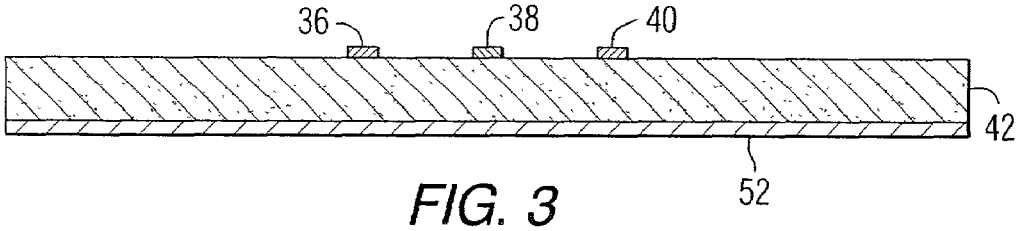
FIG. 3 is a cross-sectional view of the combline filter of FIG. 2, taken along line 3-3.

FIG. 3 is a cross-sectional view of the combline filter of FIG. 2, taken along line 3-3. A ground plane 52 is positioned on a side of the substrate opposite the resonators. The tunable capacitors can be connected to the ground plane by vias.

Figure 4:
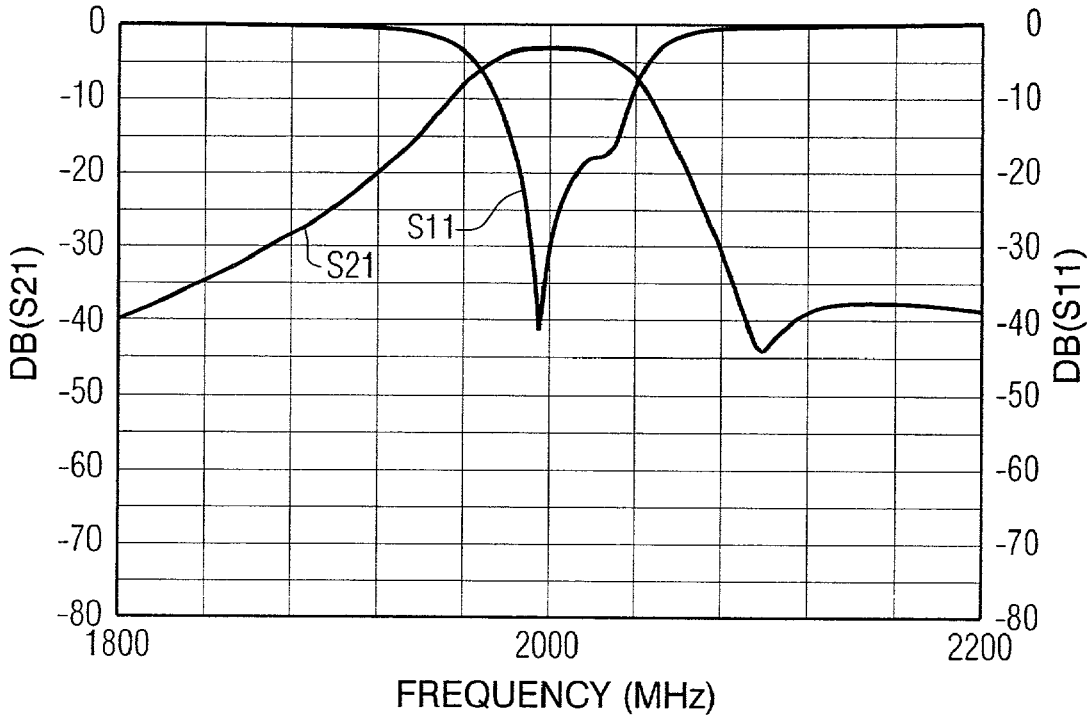
FIG. 4 is graph of the frequency response of the filter of FIG. 2 with the varactors biased at a low voltage setting.
Figure 5:
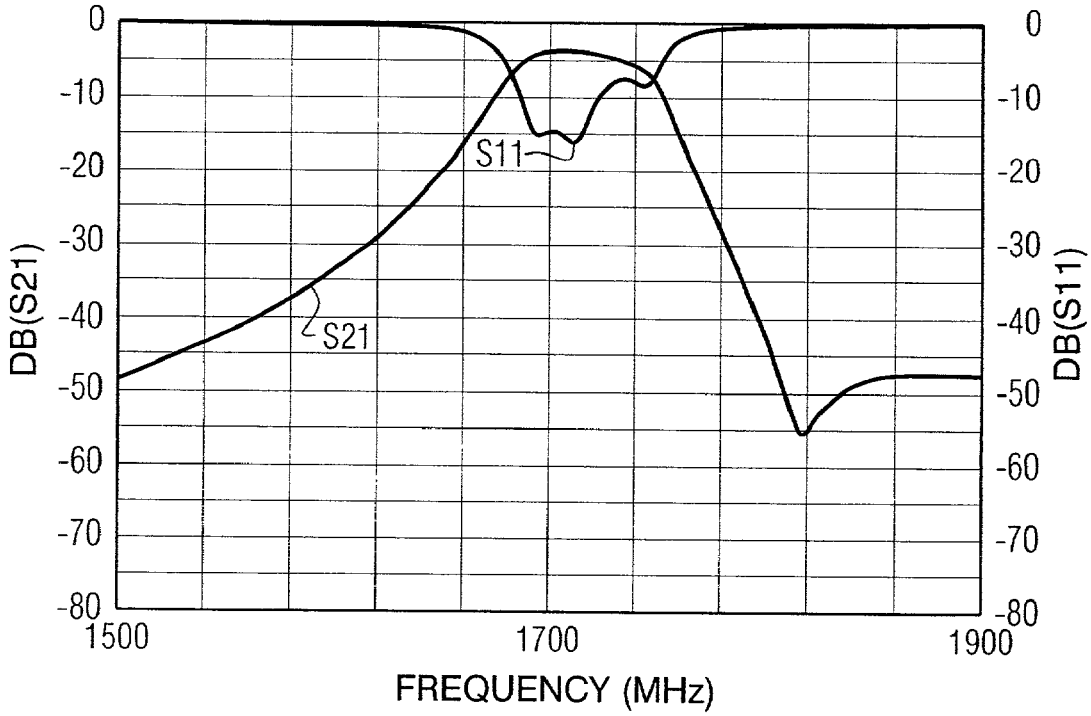
FIG. 5 is a graph of the frequency response of the filter of FIG. 2 with the varactors biased at a high voltage setting.

FIG. 4 is graph of the frequency response of the filter of FIG. 2 with the tunable dielectric varactors biased at a first, low voltage setting. FIG. 5 is a graph of the frequency response of the filter of FIG. 2 with the varactors biased at a second, high voltage setting.

Figure 6:
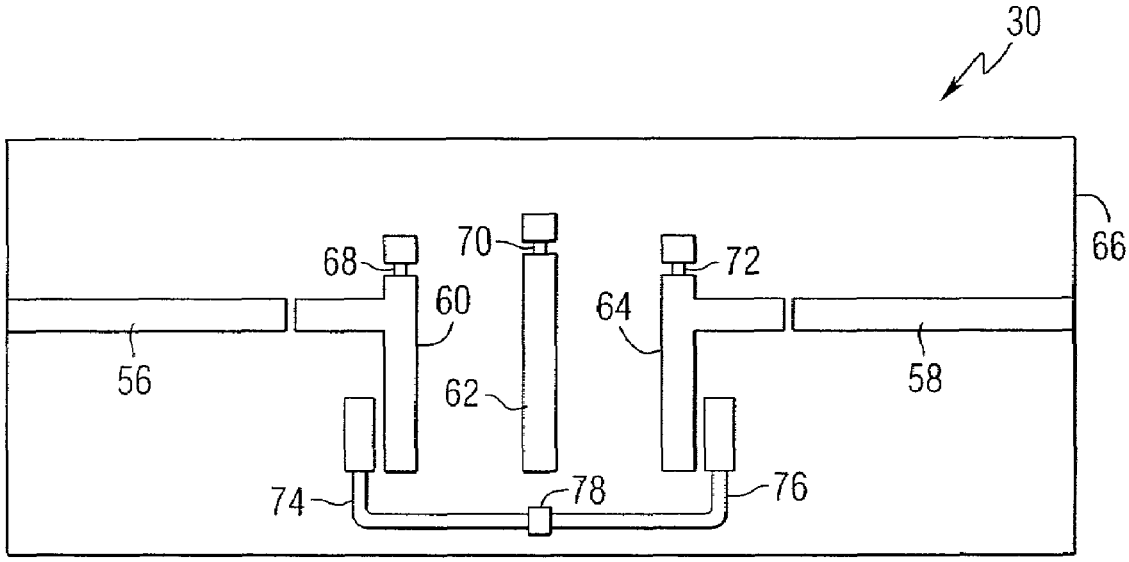
FIG. 6 is a plan view of another combline filter constructed in accordance with the invention.

Another combline bandpass filter 54 using microstrip technology is shown in FIG. 6. The filter of FIG. 6 includes an input microstrip line 56, an output microstrip line 58 and a plurality of resonators 60, 62 and 64 which a serially coupled to each other and between the input and output lines. The resonators are mounted on a dielectric substrate 66. Tunable capacitors 68, 70 and 72 are each connected between one end of one of the resonators and a ground. A pair of microstrips 74 and 76 in combination with a series connected tunable capacitor 78 serve as a means for coupling resonators 60 and 64. The filter of FIG. 6 is a 3-pole tunable combline filter with coupling between resonators 60 and 64. The use of tunable capacitor 78 permits tuning of a notch in the filter response.

Figure 7:
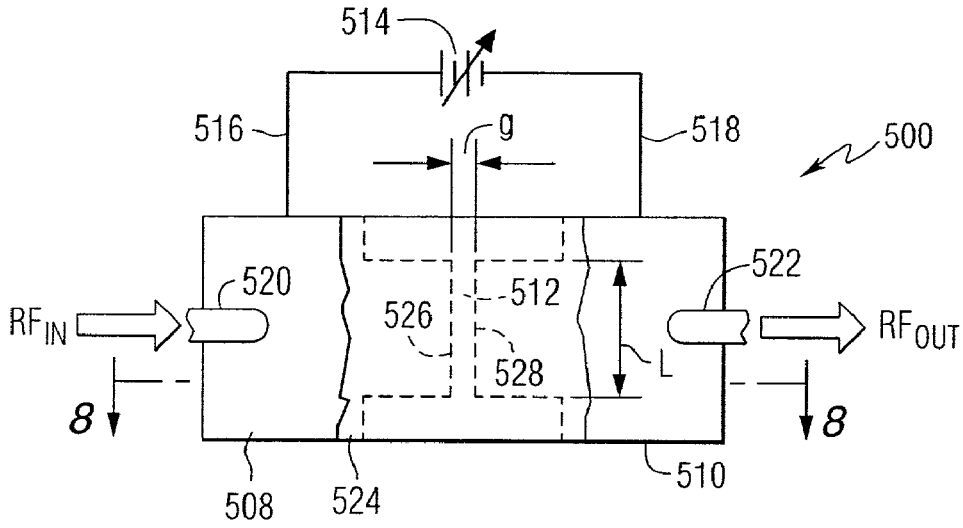
FIG. 7 is a top plan view of a voltage tunable dielectric varactor that can be used in the filters of the present invention.
Figure 8:
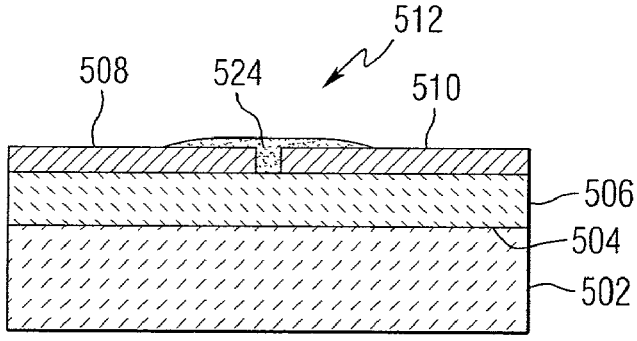
FIG. 8 is a cross sectional view of the varactor of FIG. 7, taken along line 8-8.

FIGS. 7 and 8 are top and cross sectional views of a voltage tunable dielectric varactor 500 that can be used in filters constructed in accordance with this invention. The varactor 500 includes a substrate 502 having a generally planar top surface 504. A tunable ferroelectric layer 506 is positioned adjacent to the top surface of the substrate. A pair of metal electrodes 508 and 510 are positioned on top of the ferroelectric layer. The substrate 502 is comprised of a material having a relatively low permittivity such as MgO, Alumina, $LaAlO_3$, Sapphire, or a ceramic. For the purposes of this description, a low permittivity is a permittivity of less than about 30. The tunable ferroelectric layer 506 is comprised of a material having a permittivity in a range from about 20 to about 2000, and having a tunability in the range from about 10% to about 80% when biased by an electric field of about 10 V/μm. The tunable dielectric layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof. The tunable layer can be a dielectric permittivity greater than 100 when subjected to typical DC bias voltages, for example, voltages ranging from about 5 volts to about 300 volts. A gap 22 of width g, is formed between the electrodes 18 and 20. The gap width can be optimized to increase the ratio of the maximum capacitance $C_{max}$ to the minimum capacitance $C_{min}$ ($C_{max}/C_{min}$) and increase the quality factor (Q) of the device. The optimal width, g, is the width at which the device has maximum $C_{max}/C_{min}$ and minimal loss tangent. The width of the gap can range from 5 to 50 μm depending on the performance requirements.

A controllable voltage source 514 is connected by lines 516 and 518 to electrodes 508 and 510. This voltage source is used to supply a DC bias voltage to the ferroelectric layer, thereby controlling the permittivity of the layer. The varactor also includes an RF input 520 and an RF output 522. The RF input and output are connected to electrodes 18 and 20, respectively, such as by soldered or bonded connections.

In typical embodiments, the varactors may use gap widths of less than 50 μm, and the thickness of the ferroelectric layer can range from about 0.1 μm to about 20 μm. A sealant 524 can be positioned within the gap and can be any non-conducting material with a high dielectric breakdown strength to allow the application of a high bias voltage without arcing across the gap. Examples of the sealant include epoxy and polyurethane.

The length of the gap L can be adjusted by changing the length of the ends 36 and 38 of the electrodes. Variations in the length have a strong effect on the capacitance of the varactor. The gap length can be optimized for this parameter. Once the gap width has been selected, the capacitance becomes a linear function of the length L. For a desired capacitance, the length L can be determined experimentally, or through computer simulation.

The thickness of the tunable ferroelectric layer also has a strong effect on the $C_{max}/C_{min}$ ratio. The optimum thickness of the ferroelectric layer is the thickness at which the maximum $C_{max}/C_{min}$ occurs. The ferroelectric layer of the varactor of FIGS. 7 and 8 can be comprised of a thin film, thick film, or bulk ferroelectric material such as Barium-Strontium Titanate, $Ba_xSr_{1-x}TiO_3$ (BSTO), BSTO and various oxides, or a BSTO composite with various dopant materials added. All of these materials exhibit a low loss tangent. For the purposes of this description, for operation at frequencies ranging from about 1.0 GHz to about 10 GHz, the loss tangent would range from about 0.001 to about 0.005. For operation at frequencies ranging from about 10 GHz to about 20 GHz, the loss tangent would range from about 0.005 to about 0.01. For operation at frequencies ranging from about 20 GHz to about 30 GHz, the loss tangent would range from about 0.01 to about 0.02.

The electrodes may be fabricated in any geometry or shape containing a gap of predetermined width. The required current for manipulation of the capacitance of the varactors disclosed in this invention is typically less than 1 μA. In one example, the electrode material is gold. However, other conductors such as copper, silver or aluminum, may also be used. Gold is resistant to corrosion and can be readily bonded to the RF input and output. Copper provides high conductivity, and would typically be coated with gold for bonding or with nickel for soldering.

Figure 9:
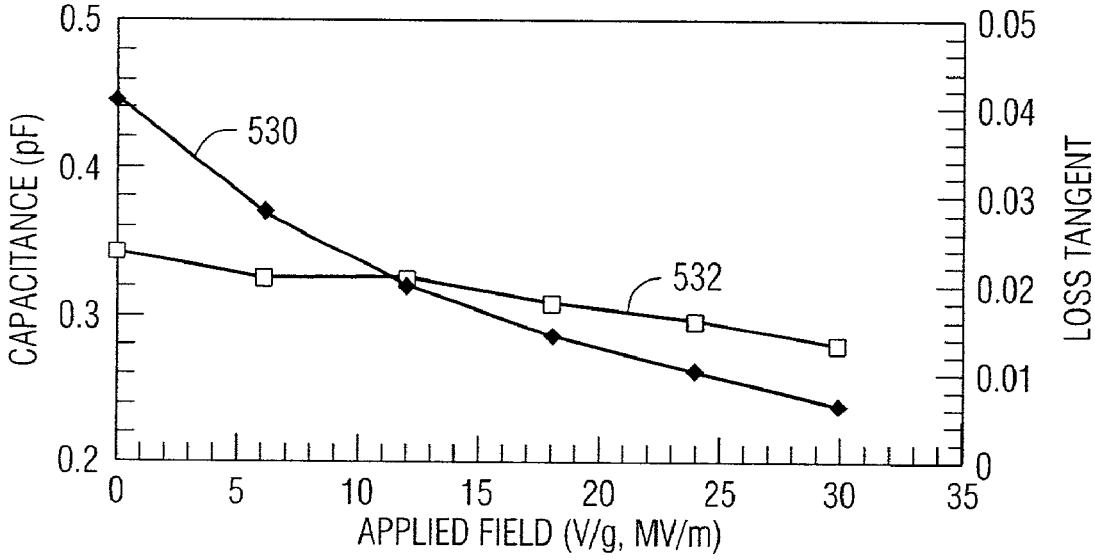
FIG. 9 is a graph that illustrates the properties of the dielectric varactor of FIG. 7.

Voltage tunable dielectric varactors as shown in FIGS. 7 and 8 can have Q factors ranging from about 50 to about 1,000 when operated at frequencies ranging from about 1 GHz to about 40 GHz. The typical Q factor of the dielectric varactor is about 1000 to 200 at 1 GHz to 10 GHz, 200 to 100 at 10 GHz to 20 GHz, and 100 to 50 at 20 to 30 GHz. $C_{max}/C_{min}$ is about 2, which is generally independent of frequency. The capacitance (in pF) and the loss factor (tan δ) of a varactor measured at 20 GHz for gap distance of 10 μm at 300° K is shown in FIG. 9. Line 530 represents the capacitance and line 532 represents the loss tangent.

Figure 10:
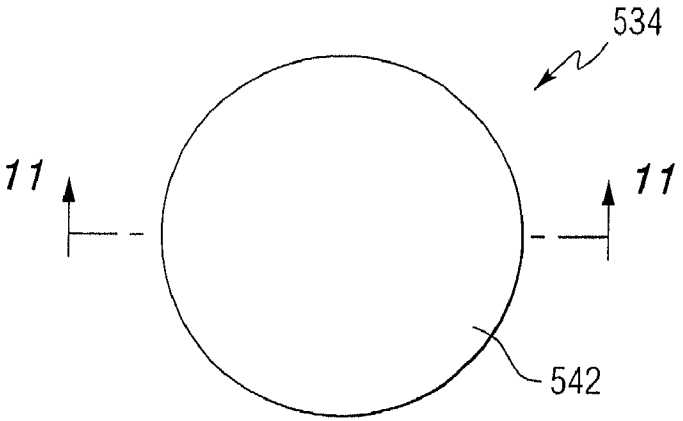
FIG. 10 is a top plan view of another voltage tunable dielectric varactor that can be used in the filters of the present invention.
Figure 11:
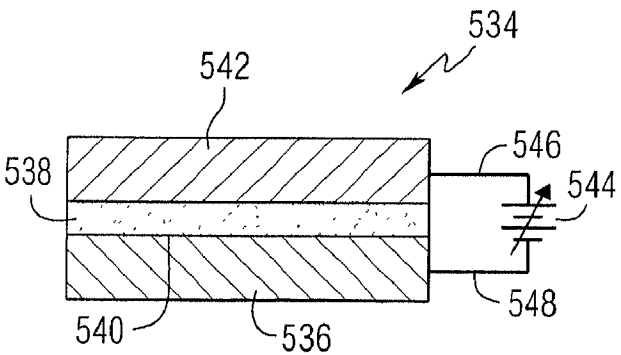
FIG. 11 is a cross sectional view of the varactor of FIG. 10, taken along line 11-11.

FIG. 10 is a top plan view of a voltage controlled tunable dielectric capacitor 534 that can be used in the filters of this invention. FIG. 11 is a cross sectional view of the capacitor 534 of FIG. 21 taken along line 11-11. The capacitor includes a first electrode 536, a layer, or film, of tunable dielectric material 538 positioned on a surface 540 of the first electrode, and a second electrode 542 positioned on a side of the tunable dielectric material 538 opposite from the first electrode. The first and second electrodes are preferably metal films or plates. An external voltage source 544 is used to apply a tuning voltage to the electrodes, via lines 546 and 548. This subjects the tunable material between the first and second electrodes to an electric field. This electric field is used to control the dielectric constant of the tunable dielectric material. Thus the capacitance of the tunable dielectric capacitor can be changed.

Figure 12:
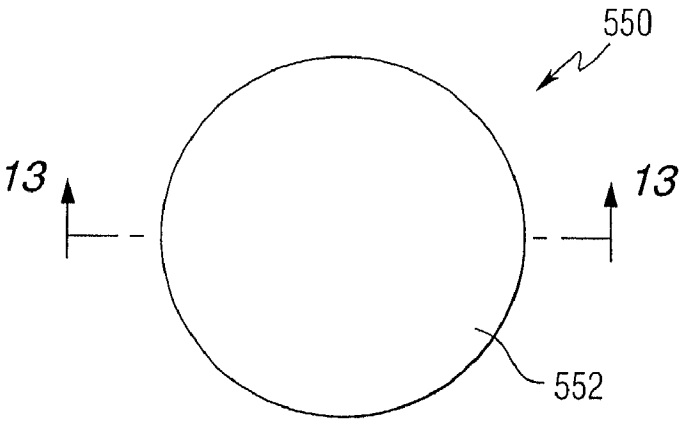
FIG. 12 is a top plan view of another voltage tunable dielectric varactor that can be used in the filters of the present invention.
Figure 13:
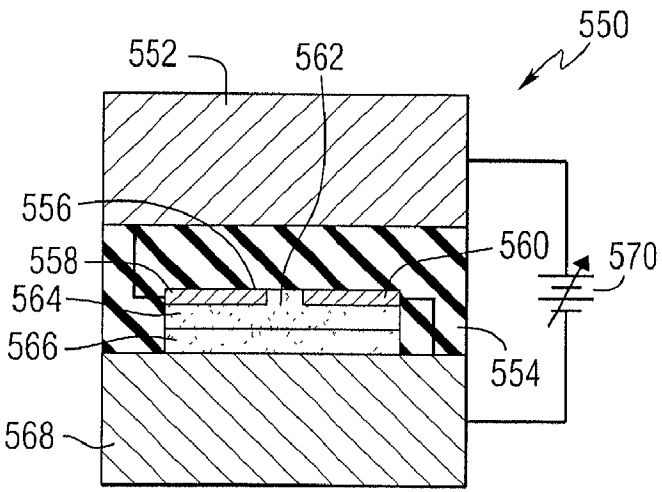
FIG. 13 is a cross sectional view of the varactor of FIG. 12, taken along line 13-13.

FIG. 12 is a top plan view of another voltage controlled tunable dielectric capacitor 550 that can be used in the filters of this invention. FIG. 13 is a cross sectional view of the capacitor of FIG. 23 taken along line 13-13. The tunable dielectric capacitor of FIGS. 12 and 13 includes a top conductive plate 552, a low loss insulating material 554, a bias metal film 556 forming two electrodes 558 and 560 separated by a gap 562, a layer of tunable material 564, a low loss substrate 566, and a bottom conductive plate 568. The substrate 566 can be, for example, MgO, $LaAlO_3$, alumina, sapphire or other materials. The insulating material can be, for example, silicon oxide or a benzocyclobutene-based polymer dielectric. An external voltage source 570 is used to apply voltage to the tunable material between the first and second electrodes to control the dielectric constant of the tunable material.

The tunable dielectric film of the tunable capacitors can be Barium-Strontium Titanate, $Ba_xSr_{1-x}TiO_3$ (BSTO) where $0<x<1$, BSTO-oxide composite, or other voltage tunable materials. Between electrodes 34 and 36, the gap 38 has a width g, known as the gap distance. This distance g must be optimized to have a higher $C_{max}/C_{min}$ ratio in order to reduce bias voltage, and increase the Q of the tunable dielectric capacitor. The typical g value is about 10 to 30 μm. The thickness of the tunable dielectric layer affects the ratio $C_{max}/C_{min}$ and Q. For tunable dielectric capacitors, parameters of the structure can be chosen to have a desired trade off among Q, capacitance ratio, and zero bias capacitance of the tunable dielectric capacitor. The typical Q factor of the tunable dielectric capacitor is about 200 to 500 at 1 GHz, and 50 to 100 at 20 to 30 GHz. The $C_{max}/C_{min}$ ratio is about 2, which is independent of frequency.

A wide range of capacitance of the tunable dielectric capacitors is available, for example 0.1 pF to 10 pF. The tuning speed of the tunable dielectric capacitors is typically about 30 ns. The voltage bias circuits, which can include radio frequency isolation components such as a series inductance, determine practical tuning speed. The tunable dielectric capacitor is a packaged two-port component, in which tunable dielectric can be voltage-controlled. The tunable film can be deposited on a substrate, such as MgO, $LaAlO_3$, sapphire, $Al_2O_3$ and other dielectric substrates. An applied voltage produces an electric field across the tunable dielectric, which produces an overall change in the capacitance of the tunable dielectric capacitor.

Tunable dielectric materials have been described in several patents. Barium strontium titanate ($BaTiO_3$—$SrTiO_3$), also referred to as BSTO, is used for its high dielectric constant (200-6,000) and large change in dielectric constant with applied voltage (25-75 percent with a field of 2 Volts/micron). Tunable dielectric materials including barium strontium titanate are disclosed in U.S. Pat. No. 5,427,988 by Sengupta, et al. entitled "Ceramic Ferroelectric Composite Material-BSTO—MgO"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO—ZnO"; U.S. Pat. No. 6,074,971 by Chiu et al. entitled "Ceramic Ferroelectric Composite Materials with Enhanced Electronic Properties BSTO—Mg Based Compound-Rare Earth Oxide". These patents are incorporated herein by reference.

Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5$ $KH_2PO_4$, and mixtures and compositions thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. patent applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases"; U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same"; U.S. application Ser. No. 09/834,327 filed Apr. 13, 2001, entitled "Strain-Relieved Tunable Dielectric Thin Films"; and U.S. Provisional Application Ser. No. 60/295,046 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one example, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In another example, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths.

To construct a tunable device, the tunable dielectric material can be deposited onto a low loss substrate. In some instances, such as where thin film devices are used, a buffer layer of tunable material, having the same composition as a main tunable layer, or having a different composition can be inserted between the substrate and the main tunable layer. The low loss dielectric substrate can include magnesium oxide (MgO), aluminum oxide ($Al_2O_3$), and lanthium oxide ($LaAl_2O_3$).

Compared to semiconductor varactor based tunable filters, tunable dielectric capacitor based tunable filters have the merits of higher Q, lower loss, higher power-handling, and higher IP3, especially at higher frequencies (>10 GHz).

Tunable microelectromachanical (MEM) capacitors can also be used in the filters of this invention. At least two MEM varactor topologies can be used, parallel plate and interdigital. In the parallel plate structure, one plate is suspended at a distance from another plate by suspension springs. This distance can vary in response to an electrostatic force between the two parallel plates induced by an applied bias voltage. In the interdigital configuration, the effective area of the capacitor is varied by moving the interdigital fingers in and out, thereby changing its capacitance value. MEM varactors have lower Q than their dielectric counterpart, especially at higher frequencies, but can be used in lower frequency applications.

The tunable filters have the ability to rapidly tune their frequency response using high-impedance control lines. The tunable materials discussed above enable these tuning properties, as well as, high Q values, low losses and extremely high IP3 characteristics, even at high frequencies.

The present invention is a tunable filter with asymmetric response. The tuning elements can be voltage-controlled tunable dielectric capacitors or MEM varactors coupled to the filter resonators. Voltage-controlled tunable dielectric capacitors have a capacitance that varies approximately linearly with applied voltage and can achieve a wider range of capacitance values than is possible with semiconductor diode varactors.

Accordingly, the present invention provides small size tunable filters that are suitable for use in wireless communications devices. These filters provide improved selectivity without complicating the filter topology.

While the present invention has been described in terms of its preferred embodiments, it will be apparent to those skilled in the art that various changes can be made to the disclosed embodiments without departing from the scope of the invention as set forth in the following claims.

What is claimed is:

1. A voltage-controlled tunable filter including:

an input;

an output;

a plurality of resonators serially coupled to each other and to the input and the output, wherein each of the resonators comprises a microstrip line;

a plurality of tunable capacitors, each of the tunable capacitors being coupled to one of the resonators;

a non adjacent resonator coupling means comprising a microstrip line and tunable capacitor connected in series with the microstrip line, said microstrip line having first and second ends, said first end capacitively coupled to one of said plurality of resonators and said second end capacitively coupled to a second of said plurality of resonators.

2. A voltage-controlled tunable filter according to claim 1, wherein the plurality of resonators are mounted on a substrate.

3. A voltage-controlled tunable filter according to claim 1, wherein at least one of said tunable capacitors includes a tunable dielectric film which comprises:

barium strontium titanate or a composite of barium strontium titanate.

4. A voltage-controlled tunable filter according to claim 1, wherein each of the tunable capacitors comprises:

a substrate;

a tunable dielectric film positioned on the substrate; and first and second electrodes positioned on a surface of the tunable dielectric film opposite the substrate, the first and second electrodes being separated to form a gap.

5. A voltage-controlled tunable filter according to claim 1, wherein the input includes a first microstrip line having an end capacitively coupled to a first one of the resonators; and wherein the output includes a second microstrip line having an end capacitively coupled to a second one of the resonators.

6. A voltage-controlled tunable filter according to claim 1, wherein the microstrip lines are positioned parallel to each other on a substrate.

7. A voltage-controlled tunable filter according to claim 1, wherein each of the tunable capacitors comprises a tunable dielectric capacitor including a layer of voltage tunable dielectric material.

8. A voltage-controlled tunable filter including:

an input;

an output;

a plurality of resonators serially coupled to each other and to the input and the outputs, wherein each of the resonators comprises a micro strip line;

a plurality of tunable capacitors, each of the tunable capacitors being coupled to one of the resonators;

said tunable capacitors comprising, a first electrode; a tunable dielectric film positioned on the first electrode; and a second electrode positioned on a surface of the tunable dielectric film opposite the first electrode, wherein the tunable dielectric film comprises a material selected from the group of:

$Ba_xSr_{1-x}TiO_3$, $Ba_xCa_{1-x}TiO_3$, $Pb_xZr_{1-x}TiO_3$, $Pb_xZr_{1-x}SrTiO_3$, $KTa_xNb_{1-x}O_3$, lead lanthanum zirconium titanate, $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5KH_2PO_4$, and compositions thereof and wherein the tunable dielectric film further comprises a non-tunable component; and a coupling means for coupling non adjacent resonators comprising a microstrip line and tunable capacitor connected in series with the microstrip line, said microstrip line having first and second ends, each capacitively coupled to one of the resonator microstrip lines.

* * * * *